US005271609A

United States Patent [19]

Kepplinger et al.

[11] Patent Number: 5,271,609

[45] Date of Patent: Dec. 21, 1993

[54] PLANT COMPRISING A SHAFT

[75] Inventors: Leopold W. Kepplinger, Leonding-Hart; Wilhelm Schiffer, Traun; Wilhelm Stastny, Alberndorf; Bernhard Rinner, Linz, all of Austria

[73] Assignee: Voest-Alpine Industrieanlagenbau GmbH, Fed. Rep. of Germany

[21] Appl. No.: 889,600

[22] Filed: May 27, 1992

[30] Foreign Application Priority Data

May 29, 1991 [AT] Austria ..... A1094/91

[51] Int. Cl.[5] ..... C21B 7/08

[52] U.S. Cl. ..... 266/199; 266/197

[58] Field of Search ..... 266/80, 197, 199

[56] References Cited

U.S. PATENT DOCUMENTS

| | | | |
|---|---|---|---|
| 4,178,151 | 12/1979 | Huestis | 432/1 |
| 4,949,940 | 8/1990 | Weber | 266/199 |
| 5,022,806 | 6/1991 | Lonardi et al. | 266/199 |

FOREIGN PATENT DOCUMENTS

| | | | |
|---|---|---|---|
| 0261432 | 3/1988 | European Pat. Off. . | |
| 1151822 | 6/1960 | Fed. Rep. of Germany . | |
| 1205997 | 1/1963 | Fed. Rep. of Germany . | |
| 1230052 | 9/1963 | Fed. Rep. of Germany . | |
| 1907224 | 9/1970 | Fed. Rep. of Germany . | |
| 3141280 | 10/1982 | Fed. Rep. of Germany . | |
| 3834969 | 4/1990 | Fed. Rep. of Germany . | |
| 1406976 | 9/1963 | France . | |
| 2256387 | 12/1973 | France . | |
| 0103705 | 8/1979 | Japan | 266/199 |
| 0128905 | 10/1979 | Japan | 266/199 |

OTHER PUBLICATIONS

Patent Abstracts of Japan; vol. 3, No. 128 (C-62) 24 Oct. 1979; & JP A 54-106 012 20 Aug. 1979.

*Primary Examiner*—Scott Kastler

*Attorney, Agent, or Firm*—Ostrolenk, Faber, Gerb & Soffen

[57] ABSTRACT

In a plant including a shaft, which, in its upper end region, includes a gas exhaust device and a charging arrangement for continuously charging bulk material, a temperature measuring device for measuring the temperature of the gas emerging from the bulk material is provided. In order to ensure the uniform treatment of the bulk material, i.e., a uniform gas passage through the same over the entire cross section of the shaft at little structural expenditures, several temperature measuring devices are provided in the upper end region of the shaft, distributed in a cross sectional plane, and the charging arrangement includes several tubular mouth pieces for forming at least one conical pile within the shaft, which are adjustable relative to the shaft cross section in the radial direction.

36 Claims, 5 Drawing Sheets

PLANT COMPRISING A SHAFT

The invention relates to a plant, in particular, a reduction shaft furnace for the direct reduction of metallic ores, comprising a shaft, which, in its upper end region, includes a gas exhaust means, a charging means for continuously charging bulk material as well as a temperature measuring means for measuring the temperature of the gas emerging from the bulk material on a plurality of sites distributedly provided over the free cross section of the shaft.

From DE-A 31 41 280 and DE-A 38 34 969, it is known to supply the bulk material to the shaft via a charging means arranged in the upper end portion of the shaft. The charging means is formed by a plurality of tubes rigidly arranged relative to the shaft, through which the bulk material gets into the shaft, forming a plurality of bulk material cones whose vertices always are on one and the same level at the mouths of the pertaining tubes. The continuous supply of bulk material has the advantage of the temperature being constant in the upper end region of the shaft, which is not the case with the discontinuous charging of bulk material, such as, for instance, at a blast furnace having a charging means designed as a rotating chute, because the bulk material introduced in batches and usually in the cold state causes a sudden drop of the gas temperature.

However, it is disadvantageous with the known continuous charging arrangements that the fine grain and coarse grain portions of the bulk material segregate on the bulk material cone, since the coarse grain portion rolls down the surface of the bulk material cone further than the fine grain portion. This causes the bulk material to be passed by gas in a non-uniform manner and, in case of the direct reduction of iron ore, results in a non-uniform degree of reduction, which becomes worse by the gases having higher temperatures on points of higher gas passage velocities.

With a so-called V-pile (known from DE-A 31 41 280), the coarser particles of the charging stock—due to segregation—get to the center, whereas the finer ones remain on the border. Thereby, the gas stream is strongly urged towards the center. With a so-called M-pile (known from DE-A 38 34 969) or an A-pile, the coarser particles flow towards the border, while the finer ones tend to remain in the center. Again, the gas stream is urged towards the border, since firstly the specific resistance of a coarse grain pile is lower and secondly the distance to the pile surface is shorter.

With the reduction of lumpy ore, the uniform gas passage and heat-up in the shaft upper part are of particular importance, because the temperature range of low temperature decrepitation (up to 750° C.) is to be passed as quickly as possible. Poorly gassed zones are heated more slowly, thus resulting in a more intensive decrepitation, which, in turn, leads to a greater pressure loss and, thus, to an even worse gas passage because of the slight void volume. In particular, with dusty gases, the ore pile may serve as a static bed filter and, thus, impede the gas passage of the border regions.

From DE-B - 1 151 822, a plant of the initially described kind is known, in which the bulk material is conveyed into the interior of the shaft at a constant supplying rate by a charging arrangement designed as a conveying belt, which charging arrangement comprises a horizontally displaceable car such that the charging stock can be introduced on various sites of the shaft cross section. The gas temperatures can be measured by means of a thermocouple arranged on the car approximately on the site on which the charging stock is dropped, and, as a function of the same, the advancing speed of the charging means may be controlled in a manner that the delivery of material is increased above sites of relatively high permeability and is decreased above sites of relatively low permeability.

What is disadvantageous in that case is the relatively complex charging arrangement, in particular, to a shaft with high gas temperatures. Furthermore, it is disadvantageous that the temperature measuring means is displaced over the cross section of the shaft with the conveying belt such that always only the temperature on one site, i.e., on the site where the charging stock is dropped can be determined. Thus, it is impossible to detect, and correct, deviations in the temperature distribution over the entire shaft cross section.

From EP-A - 0 261 432, it is known with a shaft for gas passage to control the introduction of bulk material into the shaft by way of temperature measurement. This is, however, effected not continuously, but by discontinuous charging, which is absolutely necessary according to EP-A - 0 261 432, since in the axis-near part of the shaft interior bulk material is to be charged that has another composition than that to be charged in the radially consecutive outer region of the shaft interior. In addition, there is the danger of the temperature measuring means being damaged by charging stock falling down during the charging procedure, since the temperature measuring means is arranged below the charging means.

The invention aims at avoiding these disadvantages and difficulties and has as its object to provide a plant of the initially defined kind, which ensures the uniform treatment of the bulk material, i.e., a uniform gas passage through the same over the entire cross section of the shaft, at little structural expenditures and with a high operational safety.

In accordance with the invention, this object is achieved in one aspect of the invention in that several temperature measuring means are provided in the upper end region of the shaft, distributed in a cross sectional plane, and that the charging means comprises several tubular mouth pieces for forming at least one conical pile within the shaft, which are adjustable relative to the shaft cross section in the radial direction.

In another aspect of the invention, the charging means comprises at least one tubular mouth piece for the formation of at least one conical pile within the shaft, which is adjustable in height by an actuation means.

In a further aspect of the invention, the charging means comprises a plurality of tubular mouth pieces for the formation of at least one conical pile within the shaft, which are selectively lockable by an actuation means.

Preferably, the tubular mouth piece is designed as a tubular telescope.

In a still further aspect of the invention, the tubular mouth piece is designed as a pivotable extension of a stationary charging tube.

The arrangement of the mouth pieces suitably is chosen such that they are disposed radially symmetrical relative to the shaft cross section, a tubular mouth piece advantageously being arranged centrical with respect to the shaft cross section.

A still further aspect of the invention is characterized in that charging tubes that are directed radial with respect to the shaft cross section depart from the centric charging tube and a slide is provided in the interior of the centric charging tube, which facultatively closes one or several of the radially outer mouth pieces arranged at the charging tubes, or the centric mouth piece, and is displaceable by an actuation means.

The temperature measuring means suitably are arranged on carriers extending over the shaft interior in its region comprising the charging arrangement.

Advantageously, the carriers are formed by steel tubes and the temperature measuring means as well as the measuring wires leading to the measuring means are provided within the steel tubes.

In order to be able to measure the temperature of the gases emerging from the bulk material as closely above the bulk material surface as possible, the temperature measuring means preferably are arranged between the mouth pieces.

For the automatic control of the plant according to the invention, the temperature measuring means suitably are coupled with a calculator and control unit, which, in turn, is coupled with the actuation means for displacing at least one of the mouth pieces or for displacing the slide between the central mouth piece and the radially outer mouth pieces.

BRIEF DESCRIPTION OF THE DRAWINGS

The invention will be explained in more detail by way of several embodiments and with reference to the accompanying drawings, wherein.

1 designates the upper part of a refractorily lined, substantially cylindrical shaft of a direct reduction shaft furnace, in which continuously top-charged lumpy bulk material, i.e., iron ore 3, is reduced by means of reducing ga passing the shaft 2 from bottom to top. In such a reduction process, the injection of the reducing gas usually is effected through feed ducts arranged in the lower third of the height of the shaft 2 in its shell 4.

Figure 1:
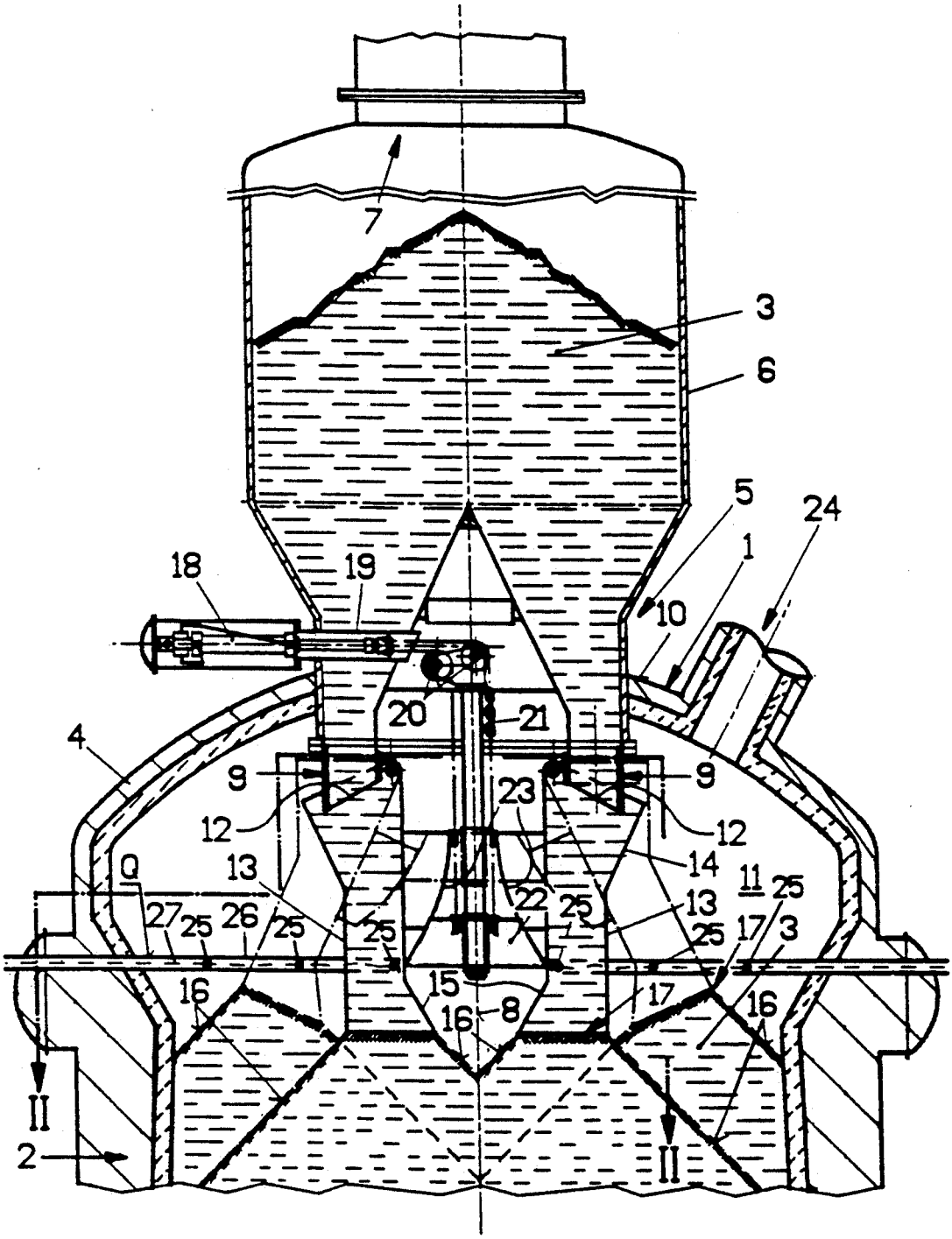
FIG. 1 is a longitudinally sectional representation of the upper part of a shaft 2 of a direct reduction furnace for the direct reduction of iron ore.

Charging of the shaft with the ferrous bulk material 3 is effected via a charging arrangement 5, which, according to the embodiment illustrated in FIG. 1, comprises a collecting vessel 6 arranged centrally relative to the shaft 2 and above the shaft 2. From the collecting vessel 6, which is continuously or discontinuously top-charged through a central opening 7, six charging tubes 9 depart, which are uniformly distributed about the longitudinal axis 8 of the shaft, reaching into the interior 11 of the shaft 2 through its ceiling 10.

To the ends 12 of the charging tubes 9 located closely below the ceiling 10, tubular mouth pieces 13 are hinged in a manner that the mouth pieces 13 are pivotable in the radial direction, viewed from the longitudinal axis 8 of the shaft 2. The upper end 14 of each substantially straight and cylindrically designed mouth piece 13 is funnel-shaped in order to span the lower end 12 of the pertaining charging tube 9 in any pivotal position of the mouth pieces 13 such that the whole bulk material 3 sliding down through the charging tubes 9 flows through the consecutively arranged mouth pieces 13, forming a conical pile 16 following the lower opening 15, which is also widened.

As is apparent from FIG. 1, the vertices 17, i.e., the upper ends of the conical piles 16, are located closer to, or farther away from, the longitudinal axis 8 of the shaft 2 and slightly higher or lower, depending on the pivotal position of the mouth pieces 13.

Pivoting of the mouth pieces from the position illustrated in full lines in FIG. 1 into the position represented in dot-and-dash lines in FIG. 1 is effected by a displacement cylinder 18 arranged above the ceiling 10 of the shaft 2 and protected by a casing, whose piston 19 is fastened to a gib 22 via a rope 21 led into the interior 11 of the shaft 2 by means of deflection pulleys 20, which gib is liftable and lowerable by the displacement cylinder 18. Runners 23 fastened to the mouth pieces 13 and projecting radially inwardly contact the gib 22, widening upwardly towards the longitudinal axis 8 in the radial direction.

Lateral of the entry openings of the charging tubes 9, a gas exhaust opening 24 is provided on the ceiling 10 of the shaft 2.

Closely above the uppermost position to be assumed by the lower openings 15 of the mouth pieces 13, several temperature measuring means 25 are distributedly provided in a cross sectional area Q of the shaft 2, and, preferably, are designed as thermocouples. These thermocouples 25 are arranged within steel tubes 26 radially extending over the cross section of the shaft 2, in which there are also led electric connecting wires 27. The steel tubes 26 project outwardly through the shell 4 of the shaft 2. The electric connection wires 27, which are led outwards by the steel tubes 26, are connected to a calculator and control unit (not illustrated), which, in turn, is coupled with the displacement cylinder 18 for adjusting the position of the mouth pieces 13 in the following manner.

With stationary piling up of the bulk material 3 in the interior 11 of the shaft 2, segregation of the bulk material occurs, because the coarse portion of the bulk material 3 rolls further outwards on the conical bulk material pile 16. Consequently, the finer bulk material 3 collects in the center of the conical pile, i.e., where the conical pile 16 has its greatest height and, thus, the longest path to be passed by gas, which, in addition to the longest path to be passed by gas, results in a gas permeability that is reduced as compared to that of the border zones of a conical pile 16. This causes a heterogenous gas passage and, thus, a non-uniform degree of reduction of the ore.

Above the sites at which the gas penetrates the bulk material 3 more rapidly, the gas emerging from the bulk material 3 has a higher temperature such that the treatment time by the gas streaming through the bulk material below the temperature measuring means 25 may be concluded from the temperature values measured in a cross sectional area Q. If the temperature values measured deviate from a set temperature value by an extent exceeding a certain value, the introduction of the bulk material 3, according to the invention, is changed by shifting the position of the conical piles 16, according to the embodiment illustrated in FIGS. 1 and 2, in the radial direction until the temperature values measured in the cross sectional plane Q are equal or only deviate by such an extent that, with regard to the cross section of the shaft 2, the gas amount streaming through the bulk material 3 may be concluded to be constant and, thus, the treatment of the bulk material 3 by the gas may be concluded to be uniform.

Figure 3:
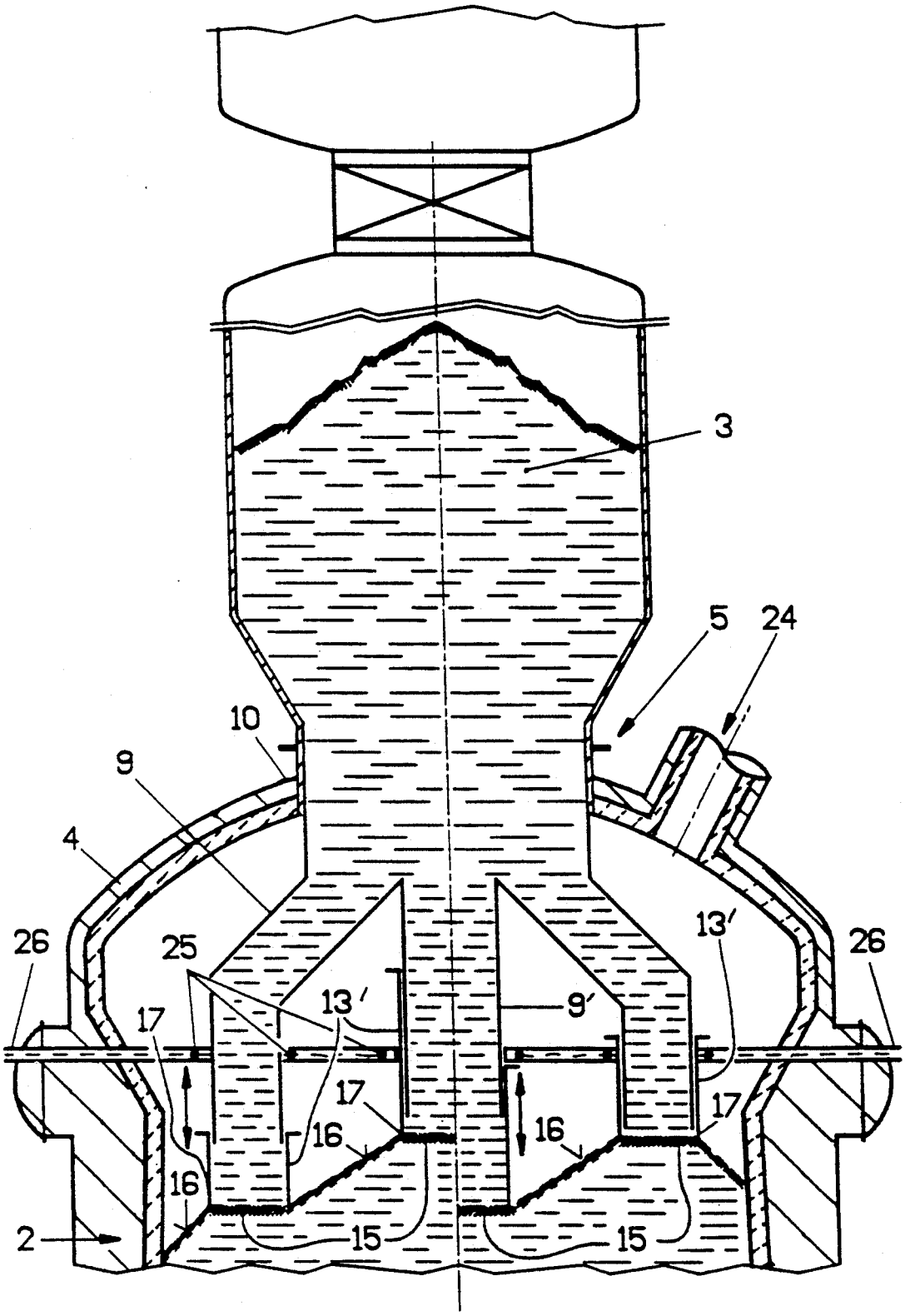
FIGS. 3, 4 and 5 each are further embodiments in illustrations analogous to FIG. 1.

According to the embodiment illustrated in FIG. 3, in which one operational state is each represented in either half of the figure, the charging arrangement 5 comprises both a central charging tube 9' and charging tubes 9 radially spaced apart from the former by a certain distance. All the charging tubes 9, 9' are each provided with a mouth piece 13' that may be telescopically slipped over the charging tube 9, 9' and fixed in various slip-on positions, whereby it is possible to place the outlet openings 15 of the charging arrangement 5 on different levels. Consequently, not only vertices 17 of the conical piles 16 that are located on different levels, but also different types of piles, such as, e.g., an A-pile as illustrated in the left half of FIG. 3, or a V-pile as illustrated in the right half of FIG. 3, result.

Figure 4:
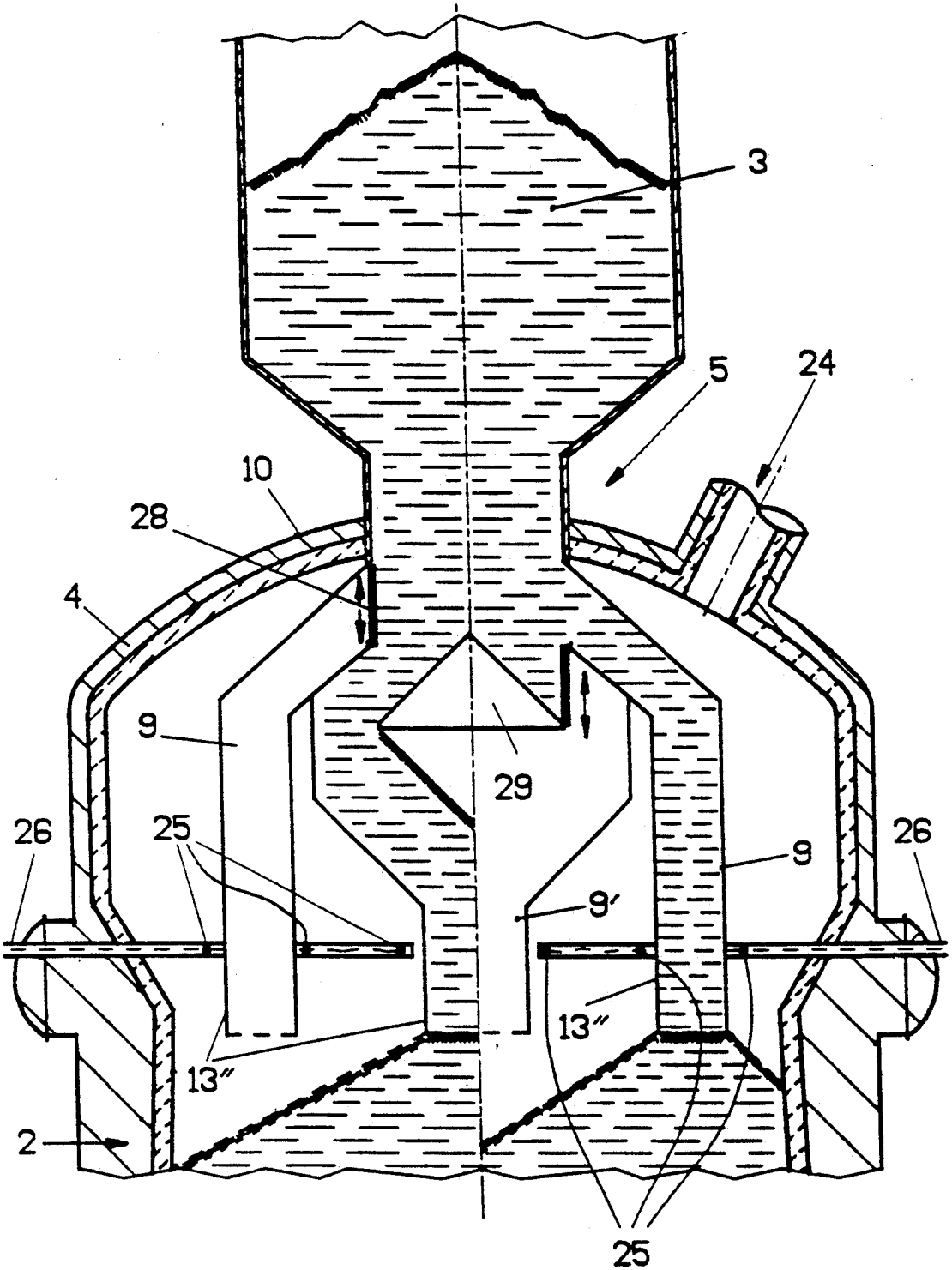

The embodiment illustrated in FIG. 4 also allows for variations between a V-pile and an A-pile, the illustration being analogous to FIG. 3. There, a slide 28 designed as a cylinder is provided in the interior of the charging arrangement 5, which is movable in various positions in the vertical direction and fixable in these positions, and which, in the lifted position, closes the radially outer mouth pieces 13", which are designed in one piece with the charging tubes 9, 9", and, in the lowered position, locks the centrally arranged mouth piece 13" by aid of a conical insert 29 arranged centrically within the same.

Figure 2:
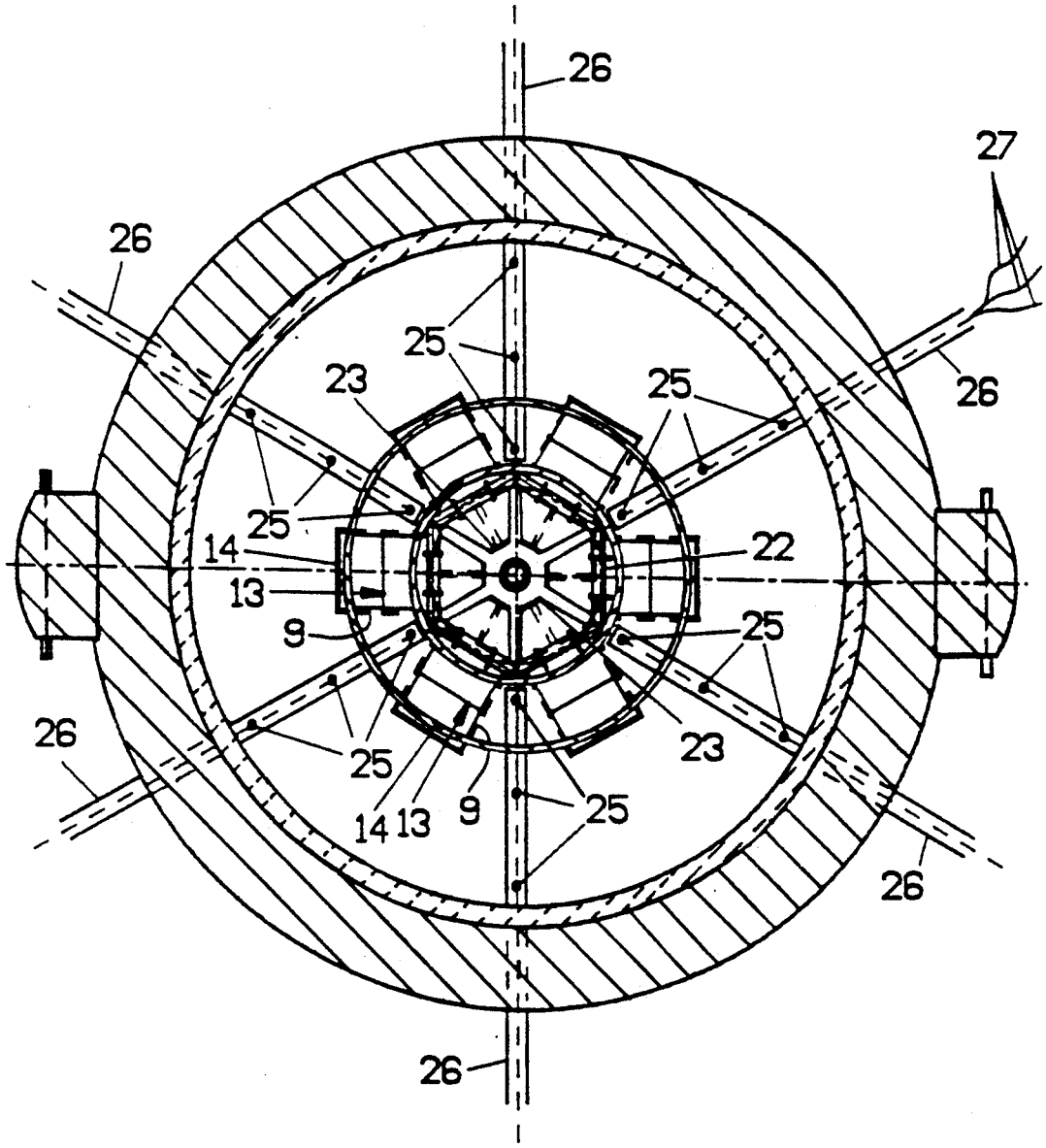
FIG. 2 is a section laid along line II—II of FIG. 1 according to a first embodiment.
Figure 5:
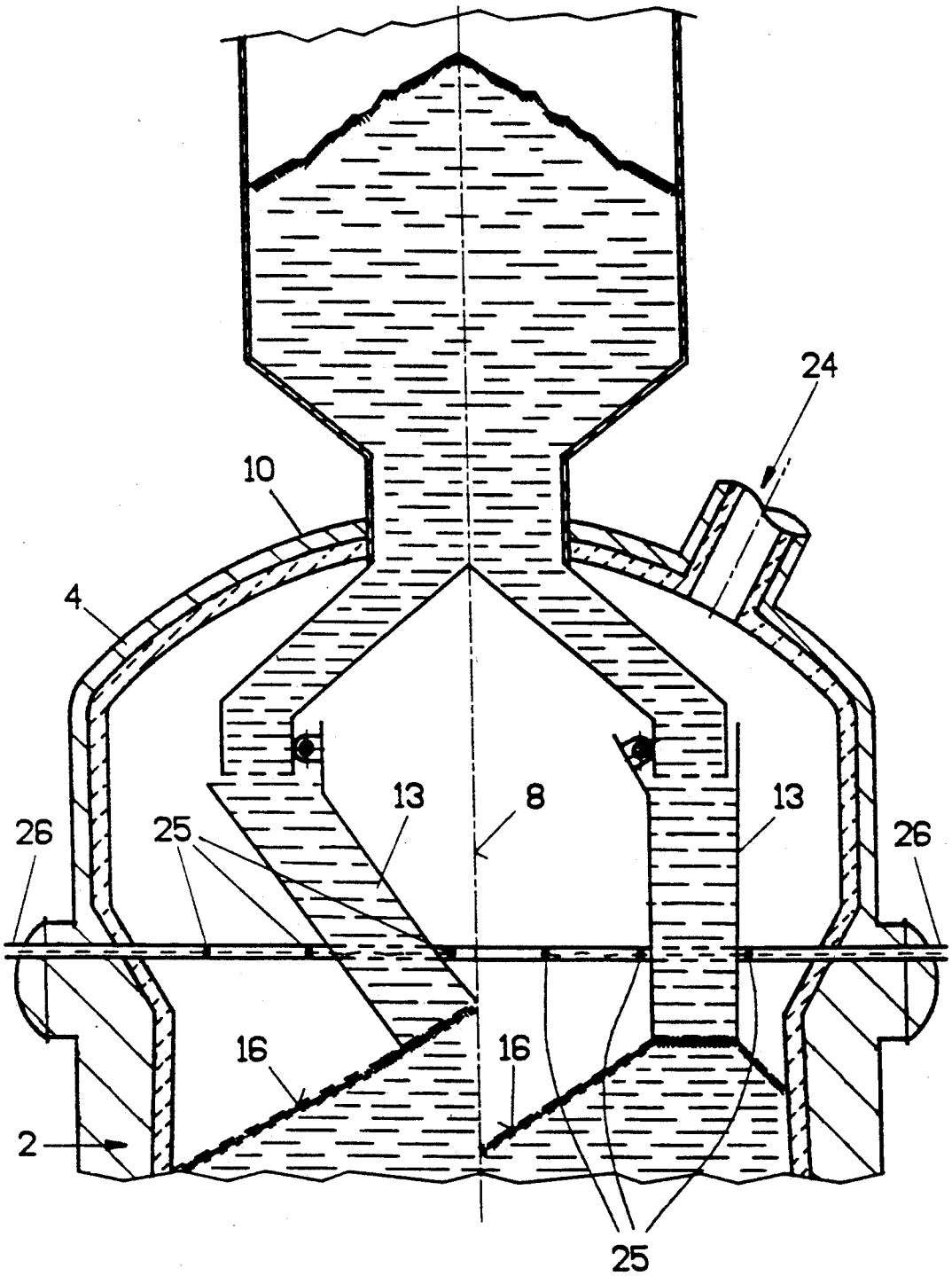

According to the embodiment illustrated in FIG. 5, which resembles that illustrated in FIGS. 1 and 2, the pivotability of the mouth pieces 13 is chosen such that an exact A-pile may be obtained as the mouth pieces 13 are pivoted inwardly as far as to the longitudinal axis 8 of the shaft 2.

What we claim is:

1. In a plant comprising a shaft having a shaft cross section and an upper end region including a gas exhaust means for discharging gas, a charging means including charging tubes for continuously charging bulk material as well as temperature measuring means for measuring the temperature of said gas emerging from said bulk material on a plurality of sites distributed over the free cross section of said shaft, the improvement wherein a plurality of said temperature measuring means are distributed in said upper end region of said shaft in a cross sectional plane and said charging means comprises several tubular mouth pieces arranged on said charging tubes and displaceable relative to the cross section of said shaft in the radial direction and adapted to form at least one conical pile of said bulk material within said shaft.

2. In a plant comprising a shaft having a shaft cross section and an upper end region including a gas exhaust means for discharging gas, a charging means including charging tubes for continuously charging bulk material as well as temperature measuring means for measuring the temperature of said gas emerging from said bulk material on a plurality of sites distributed over the free cross section of said shaft, the improvement wherein a plurality of said temperature measuring means are distributed in said upper end region of said shaft in a cross sectional plane and said charging means comprises at least one tubular mouth piece arranged on a charging tube and adapted to form at least one conical pile of said bulk material within said shaft, and wherein an actuation means is provided for varying the level of said at least one mouth piece within said shaft.

3. In a plant comprising a shaft having a shaft cross section and an upper end region including a gas exhaust means for discharging gas, a charging means including charging tubes for continuously charging bulk material as well as temperature measuring means for measuring the temperature of said gas emerging from said bulk material on a plurality of sites distributed over the free cross section of said shaft, the improvement wherein a plurality of said temperature measuring means are distributed in said upper end region of said shaft in a cross sectional plane and said charging means comprises a plurality of tubular mouth pieces arranged on said charging tubes and adapted to form at least one conical pile of said bulk material within said shaft, and wherein an actuation means is provided for selectively locking said plurality of mouth pieces.

4. A plant as set forth in claim 1, wherein said tubular mouth piece is designed as a telescopic tube.

5. A plant as set forth in claim 1, wherein said tubular mouth piece is designed as a pivotable extension of a stationary charging tube.

6. A plant as set forth in claim 1, wherein said mouth pieces are arranged radially symmetrical with respect to the shaft cross section.

7. A plant as set forth in claim 6, wherein one tubular mouth piece is arranged centrical with respect to the shaft cross section and the remaining mouth pieces are radially outer tubular mouth pieces arranged on said charging tubes.

8. A plant as set forth in claim 7, wherein said charging means comprises a centric charging tube and a plurality of charging tubes directed radial with respect to the shaft cross section and departing from said centric charging tube, and further comprising a slide provided within said centric charging tube and adapted to optionally lock one of at least one radially outer tubular mouth piece and said centric mouth piece arranged on its respective charging tube, and a slide actuation means provided for displacing said slide.

9. A plant as set forth in claim 1, further comprising carriers spanning the shaft interior in its region containing said charging means for accommodating said temperature measuring means.

10. A plant as set forth in claim 9, further comprising measuring wires leading to said temperature measuring means and wherein said carriers are comprised of steel tubes, said temperature measuring means and said measuring wires being arranged within said steel tubes.

11. A plant as set forth in claim 8 wherein said temperature measuring means are arranged between said mouth pieces.

12. A plant as set forth in claim 11, further comprising a calculator and control unit coupled with said temperature measuring means, said calculator and control unit also being coupled with at least one of said actuation means for displacing at least one mouth piece and said slide actuation means for displacing said slide between said central mouth piece and said radially outer mouth pieces.

13. A plant as set forth in claim 9, wherein said temperature measuring means are arranged between said mouth pieces.

14. A plant as set forth in claim 13, further comprising a calculator and control unit coupled with said temperature measuring means, said calculator and control unit also being coupled with at least one of said actuation means for displacing at least one mouth piece and said slide actuation means for displacing said slide between said central mouth piece and said radially outer mouth pieces.

15. A plant as set forth in claim 2, wherein said tubular mouth piece is designed as a telescopic tube.

16. A plant as set forth in claim 2, wherein said tubular mouth piece is designed as a pivotable extension of a stationary charging tube.

17. A plant as set forth in claim 2, wherein said mouth pieces are arranged radially symmetrical with respect to the shaft cross section.

18. A plant as set forth in claim 17, wherein one tubular mouth piece is arranged centrical with respect to the shaft cross section and the remaining mouth pieces are radially outer tubular mouth pieces arranged on said charging tubes.

19. A plant as set forth in claim 18, wherein said charging means comprises a centric charging tube and a plurality of charging tubes directed radial with respect to the shaft cross section and departing from said centric charging tube, and further comprising a slide provided within said centric charging tube and adapted to optionally lock one of at least one radially outer tubular mouth piece and said centric mouth piece arranged on its respective charging tube, and a slide actuation means provided for displacing said slide.

20. A plant as set forth in claim 19, wherein said temperature measuring means are arranged between said mouth pieces.

21. A plant as set forth in claim 20, further comprising a calculator and control unit coupled with said temperature measuring means, said calculator and control unit also being coupled with at least one of said actuation means for displacing at least one mouth piece and said slide actuation means for displacing said slide between said central mouth piece and said radially outer mouth pieces.

22. A plant as set forth in claim 2, further comprising carriers spanning the shaft interior in its region containing said charging means for accommodating said temperature measuring means.

23. A plant as set forth in claim 22, further comprising measuring wires leading to said temperature measuring means and wherein said carriers are comprised of steel tubes, said temperature measuring means and said measuring wires being arranged within said steel tubes.

24. A plant as set forth in claim 22, wherein said temperature measuring means are arranged between said mouth pieces.

25. A plant as set forth in claim 24, further comprising a calculator and control unit coupled with said temperature measuring means, said calculator and control unit also being coupled with at least one of said actuation means for displacing at least one mouth piece and said slide actuation means for displacing said slide between said central mouth piece and said radially outer mouth pieces.

26. A plant as set forth in claim 3, wherein said tubular mouth piece is designed as a telescopic tube.

27. A plant as set forth in claim 3, wherein said tubular mouth piece is designed as a pivotable extension of a stationary charging tube.

28. A plant as set forth in claim 3, wherein said mouth pieces are arranged radially symmetrical with respect to the shaft cross section.

29. A plant as set forth in claim 28, wherein one tubular mouth piece is arranged centrical with respect to the shaft cross section and the remaining mouth pieces are radially outer tubular mouth pieces arranged on said charging tubes.

30. A plant as set forth in claim 29, wherein said charging means comprises a centric charging tube and a plurality of charging tubes directed radial with respect to the shaft cross section and departing from said centric charging tube, and further comprising a slide provided within said centric charging tube and adapted to optionally lock one of at least one radially outer tubular mouth piece and said centric mouth piece arranged on its respective charging tube, and a slide actuation means provided for displacing said slide.

31. A plant as set forth in claim 30, wherein said temperature measuring means are arranged between said mouth pieces.

32. A plant as set forth in claim 31, further comprising a calculator and control unit coupled with said temperature measuring means, said calculator and control unit also being coupled with at least one of said actuation means for displacing at least one mouth piece and said slide actuation means for displacing said slide between said central mouth piece and said radially outer mouth pieces.

33. A plant as set forth in claim 3, further comprising carriers spanning the shaft interior in its region containing said charging means for accommodating said temperature measuring means.

34. A plant as set forth in claim 33, further comprising measuring wires leading to said temperature measuring means and wherein said carriers are comprised of steel tubes, said temperature measuring means and said measuring wires being arranged within said steel tubes.

35. A plant as set forth in claim 33, wherein said temperature measuring means are arranged between said mouth pieces.

36. A plant as set forth in claim 35, further comprising a calculator and control unit coupled with said temperature measuring means, said calculator and control unit also being coupled with at least one of said actuation means for displacing at least one mouth piece and said slide actuation means for displacing said slide between said central mouth piece and said radially outer mouth pieces.

* * * * *

UNITED STATES PATENT AND TRADEMARK OFFICE

CERTIFICATE OF CORRECTION

PATENT NO. :5,271,609
DATED :December 21, 1993
INVENTOR(S) :Kepplinger et al

It is certified that error appears in the above-indentified patent and that said Letters Patent is hereby corrected as shown below:

On the title page, Item [73] change the Assignee's name to --DEUTSCHE VOEST-ALPINE INDUSTRIEANLAGENBAU GMBH --.

Signed and Sealed this

Twenty-ninth Day of November, 1994

*Attest:*

Bruce Lehman

BRUCE LEHMAN

*Attesting Officer*

*Commissioner of Patents and Trademarks*